United States Patent [19]

Mori

[11] 4,135,319

[45] Jan. 23, 1979

[54] INDEXING DEVICE

[75] Inventor: Chuzo Mori, Tateishi, Japan

[73] Assignee: Carl Manufacturing Co., Ltd., Tokyo, Japan

[21] Appl. No.: 752,995

[22] Filed: Dec. 21, 1976

[30] Foreign Application Priority Data

Dec. 23, 1975 [JP] Japan ..... 50-153557

[51] Int. Cl.[2] ..... B42F 17/34

[52] U.S. Cl. ..... 40/389

[58] Field of Search ..... 40/104.01, 68.4, 78.05, 40/378, 389

[56] References Cited

U.S. PATENT DOCUMENTS

| | | | |
|---|---|---|---|
| 2,329,300 | 9/1943 | Rummler | 40/104.01 |
| 2,541,881 | 2/1951 | Menning et al. | 40/104.01 |
| 2,799,955 | 7/1957 | Neilsen | 40/104.01 |
| 2,849,815 | 9/1958 | Neilsen | 40/104.01 |

FOREIGN PATENT DOCUMENTS

| | | | |
|---|---|---|---|
| 1154437 | 9/1963 | Fed. Rep. of Germany | 40/104.01 |
| 779325 | 7/1957 | United Kingdom | 40/104.01 |

*Primary Examiner*—John F. Pitreli

*Attorney, Agent, or Firm*—Littlepage, Quaintance, Murphy, Richardson and Webner

[57] ABSTRACT

An indexing device is constructed such that a plurality of cards are filed in order between a base member of the device and a cover member pivotaly secured to the base member. The cards have protruding marginal edges such that, when the cards are filed in order in the device, the exposed portions of the respective marginal edges are in a sequential step-wise arrangement. A plurality of push-buttons are provided in the cover member in correspondence to the marginal edges of the respective cards such that one can select the desired card or page and open the cover member together with that card by a single push-button pressing operation.

16 Claims, 7 Drawing Figures

INDEXING DEVICE

BACKGROUND OF THE INVENTION (1) Field of the Invention

This invention relates to indexing devices of the type having a plurality of cards kept in file between a base member of a case and a cover member pivotally secured to said base member, and more particularly to indexing devices designed such that one can open the device to any desired page together with the cover member by simply operating one of a plurality of operating arms provided inside said cover member.

(2) Description of the Prior Art

The more conventional and popular type of indexing devices comprise generally a base member, a cover member pivotally secured thereto, and a plurality of cards kept in file between the base and cover members. A selection pawl is slidably, mounted to the cover member for selecting a desired card from the plurality of cards and holding the selected card in position. An alphabetic array of letters or other index signs is provided on the cover member corresponding to pre-established possible positions of the selection pawl. A separate locking mechanism is provided between the cover member and base. To operate such devices, however, the user must perform two different operations; that is, selecting a card with the selection pawl and opening the case cover with the separate locking mechanism.

Also known are indexing devices of the type in which a plurality of selectors are associated with the respective cards or pages of the index. The selectors are positioned in the base member and the selectors are interlocked with the cover locking mechanism so that one can accomplish both card selection and cover opening simultaneously by operating one of said selectors. However, such devices also involves some serious drawbacks. Since the card selecting mechanism is provided in the base, the size of the base is inevitably enlarged in comparison with the card size. Also, the internal mechanism is typically complicated and the number of necessary parts is large thus resulting in a greater amount of labor and elevated cost for manufacture.

SUMMARY OF THE INVENTION

The principal object of this invention is to provide an improved indexing device in which a plurality of cards are filed between a base member and a cover member pivotally secured thereto, the cards having formed at their free ends protruding marginal edges or half-tabs arranged such that when the cards are laid one over another, the exposed portions of the marginal edges will be positioned staggeringly or in step-wise fashion with respect to each other. A plurality of selecting arms are provided inside the cover member in correspondence to the exposed positions of the respective marginal edges so that one can open the cover member together with a selected number of cards by a single selector arm operation.

Another object of this invention is to avoid unnecessary enlargement of the base member relative to the card size thus making the device compact by utilizing the internal space of the cover member for disposition of the selector arms.

Still another object of this invention is to simplify the user's hand movement required for the cover opening and closing operations by providing the operating buttons for operating the selector arms in the cover member of the device.

Yet another object of this invention is to facilitate manufacture of the selector arms as well as their adaptation to the cover member by constituting said plurality of selection arms from the tooth portions of a pectinate plate on a common mount.

Other objects of this invention will become apparent from reading the following detailed description of the invention given in conjunction with the accompanying drawings.

DESCRIPTION OF A PREFERRED EMBODIMENT

Shown and described hereinbelow as an embodiment of this invention is a push-button type indexing device.

Figure 1:
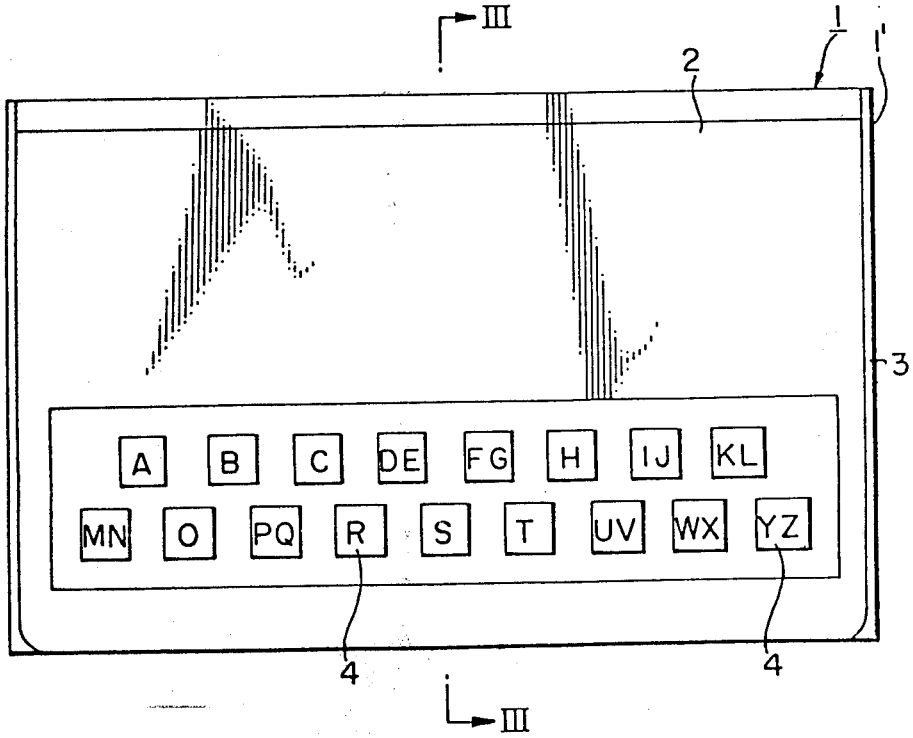
FIG. 1 is a plan view of an indexing device according to this invention.
Figure 2:
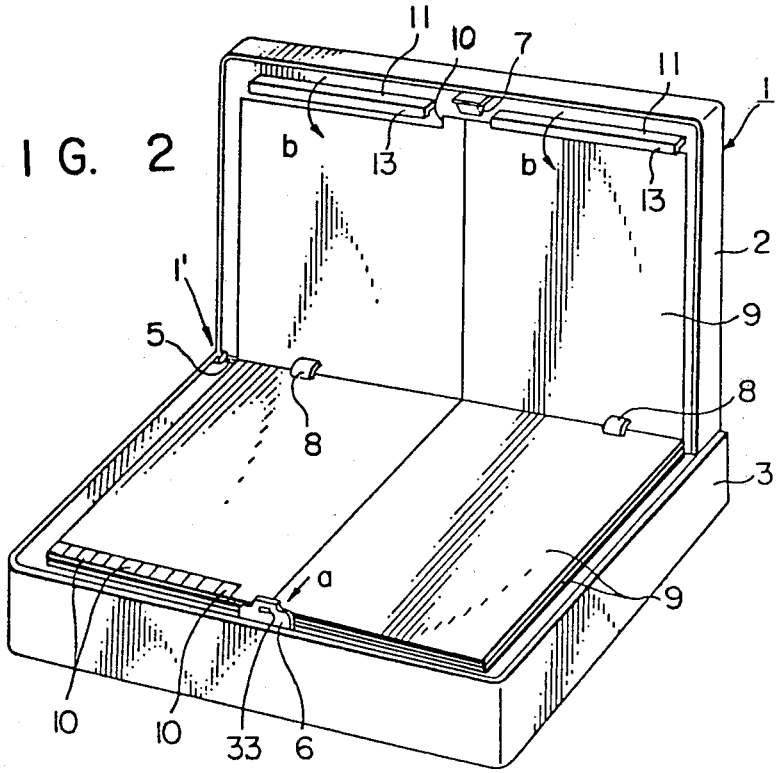
FIG. 2 is a perspective view of the indexing device shown in FIG. 1, the device being shown with its cover member being opened.

Referring to FIG. 1, there is shown a push-button type indexing device, generally designated by numeral 1, with its cover 2 being in its closed position relative to the base member 3. It will be noted that said cover 2 is pivotally secured at 1' to the base member 3 so that said cover may be pivotally opened and closed. If one of the operating buttons 4 arranged on the cover 2 is pressed under this condition, the mechanism locking said base 3 and cover 2 to each other is unlocked to allow the cover 2 to pivotally open up as shown in FIG. 2. Simultaneously with such opening of the cover 2, the card or page corresponding to the pressed button is selected from a multiplicity of cards by a process of operations described later, thereby allowing selection of the desired page simultaneously with the opening motion of the cover 2. It will be also seen that each of said operating buttons 4 bears on its surface an alphabetic letter or letters for indexing.

Figure 3:
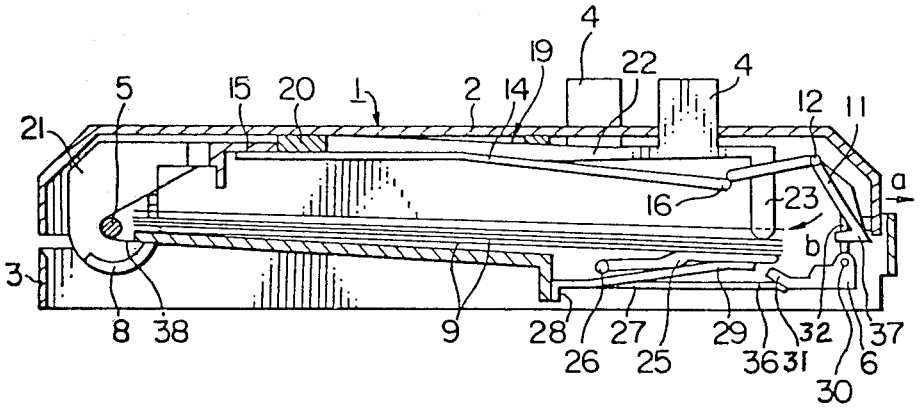
FIG. 3 is a sectional view taken along the line III—III of FIG. 1.

As shown in FIGS. 2 and 3, the cover 2 is pivotally joined at its lower side by a shaft 5 passed through the corresponding side of the base 3. At the center of the front side (opposite from the pivoted side) of said base 3 a lock arm 6 is provided which is normally pressed in the direction of arrow a by a spring means so that when the cover 2 is brought to its closed position, said lock arm 6 engages a corresponding protuberance or lug 7 provided at the center of the front side (upper side in the drawing) of said cover 2 to secure both said cover 2 and said base 3 in the closed condition.

At the lower or pivoted end of the cover 2 are provided substantially C-shaped card binding clicks 8, whereby a plurality of cards 9, can be filed between the base 3 and cover 2. At the front or free end of each of the cards 9 is provided a protuberant marginal or half-tab 10. The marginal edges 10 of the respective cards 9 are so arranged that when the cards 9 are filed in order in the device, the exposed portion of the half-tabs form a step-wise progression with respect to each other, the marginal edges 10, differing from each other in length to form half-tabs of sequentially diminishing dimension.

Figure 7:
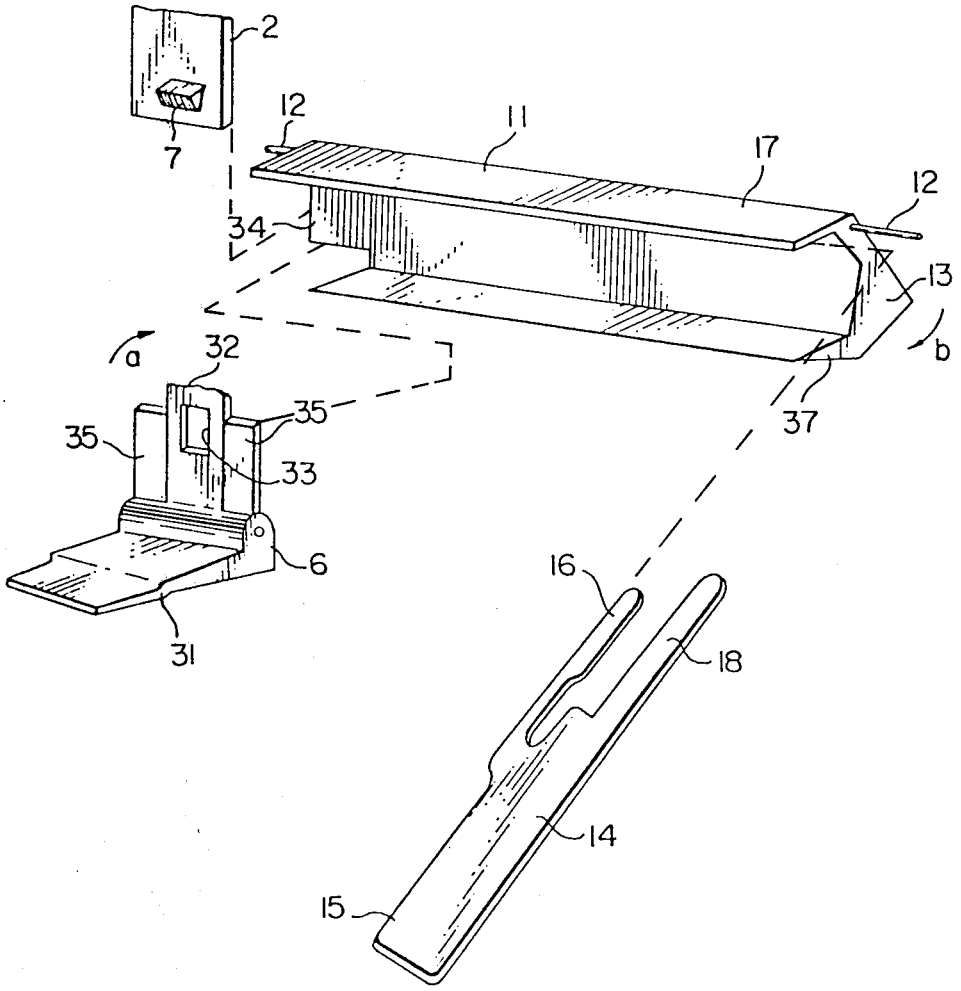
FIG. 7 is an enlarged exploded perspective view showing a protuberance or lug formed at an end of the cover member, a retainer arm secured to said cover member, a lock arm secured to the base member, and a leaf spring adapted to give a pressing force to said retainer arm.

Along the front side of, and internally of, the cover 2 is provided a card-retaining means illustrated as a pair of retainer arms 11, pivoted upon respective shafts 12, and disposed adjacent to the marginal edges 10 of the cards 9. Each of the retainer arms 11 is substantially C-shaped in cross-section, the lower portion thereof comprising a hook 37, as illustrated in FIG. 7, oriented toward the cards 9. As illustrated, each retainer arm 11 is biased in the direction of gripping the cards which is in the direction of arrow b in FIG. 3 by a pair of leaf springs 14, provided on both ends of the said arm 11. The pair of retainer arms 11 may be formed integrally with each other as a single card-retaining means.

Each of the left springs 14 is secured at one end, the proximal end 15, to the cover 2 while the other end is forked as shown in FIG. 7. One portion 16 of said forked end abuts against and presses the underside of the upper arm portion 17 of the retainer arm 11 while the other portion 18 (see FIG. 7) abuts against the corresponding shaft 12 to support it in position.

Figure 4:
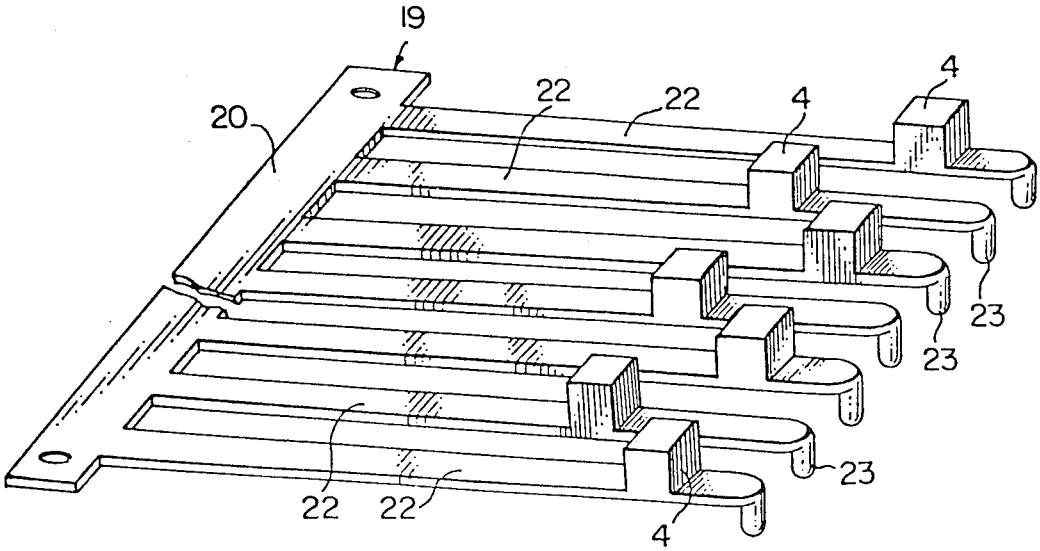
FIG. 4 is partial perspective view of a pectinate plate forming a plurality of selector arms.

Also provided inside the cover 2 is a pectinated structure 19 such as shown in FIG. 4. The end 20 of this pectinated structure 19 is secured to a bearing 21 of the cover 2 as shown in FIG. 3. The teeth of said pectinated structure 19 constitute respectively the selector arms 22 which are so arranged that lobes 23 on the underside of the arms 22 are positioned just above the exposed portions of the half-tabs 10 of the cards 9 as shown in FIG. 3. Each said arm 22 is also provided on its upper side with a protuberant operating button 4 for operating the arm 22. Normally, each push bottom 4 projects upwardly from the surface of the cover 2 through an opening 24 formed in the cover 2. The pectinated structure 19 is preferably made of a resilient plastic material integrally with the lobes or push bars 23 and the operating buttons 4 so as to be flexible.

Figure 5:
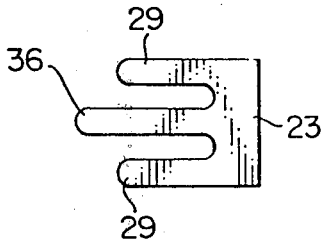
FIG. 5 is a plan view of a leaf spring provided below the pile of cards.

Disposed along the underside of the lower card 9 is an actuator plate 25 having its proximal end pivotally secured to the base 3 by means of a shaft 26 passed transversely across the base 3. The actuator plate 25 is kept in its horizontal position by a leaf spring 27. The proximal end 28 of the leaf 27 is secured to the base 3 while the other end is trifurcated as shown in FIG. 5, with both side pieces 29 thereof being in abutment against the underside of said actuator plate 25 to support it (see FIG. 5).

Figure 6:
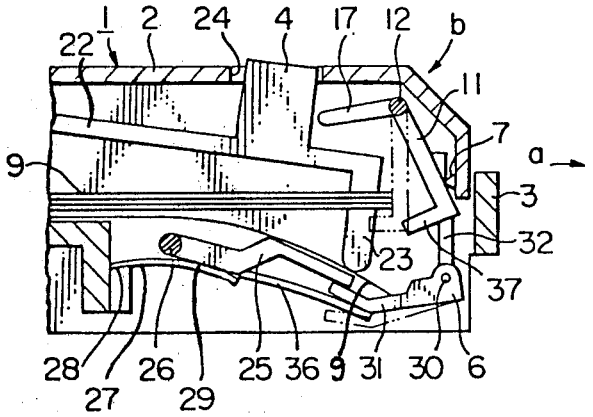
FIG. 6 is an enlarged sectional view of a principal mechanism in the device shown in FIG. 3.

As shown in FIGS. 3, 6, and 7, a lock arm 6 is pivotally secured to the base 3 by a pivot 30. This lock arm 6 is substantially L-shaped in section, and the lower portion 31 of said arm 6 is disposed beneath the actuator plate 25. In the upper arm portion 32 of said arm 6 is formed a hole 33 designed to receive and engage the protuberance 7 of the cover 2. This protuberance 7 and hole 32 constitute a lock mechanism. On both sides of said hole 32 are formed a pair of engaging pawls 35 designed to engage the corresponding flaps 34 formed on each retainer arm 11. It will also be noted that the central piece 36 of the trifurcated end of said left spring 27 abuts against the underside of the lower arm portion 31 of said lock arm 6 to press said arm 6 in the direction of arrow a in FIGS. 2, 3, and 6.

When the cover 2 is in its closed position, the protuberance 7 of the cover 2 is engaged in the hole 33 in the lock arm 6 and the engaging pawls 35 of the lock arm 6 are engaged with the corresponding flaps 34 of the retainer arms 11 as shown in FIG. 6. Accordingly, the hooked portions 37 of the retainer arms 11 stay away from the marginal edges 10 of the cards 9.

When the user depresses (downwardly in the drawing) an operating button 4 carrying the desired alphabetic letter or letters, the selector arm 22 integral with said particular button 4 is accordingly displaced downwardly so that its push bar 23 depresses the marginal edge 10 of the card 9 of the desired page. By this operation, the cards 9 are divided into an upper and a lower group bounded by the particular card selected. The actuator plate 25 is displaced downwardly against the force of leaf spring 27 in obedience to the depressed lower group of cards to press the lower arm portion 31 of the lock arm 6 downwardly. Thus, the lock arm 6 is turned opposite the direction of arrow a in the drawing against the force of portion 36 of the leaf spring 27. Consequently, the hole 33 in the arm 6 moves away from the protuberance 7 of the cover 2 to release the locking mechanism of the base 3 and cover 2, allowing the cover 2 to move upwardly to its open position under the force of spring 38 (see FIG. 3). Upon release of said locking mechanism, the engaging pawls 35 of the lock arm 6 are disengaged from the corresponding flaps 34 of the respective retainer arms 11, whereby the retainer arms 11 are freed and urged to turn in the direction of arrow b under the force of paired leaf springs 14 until said arms grip the upper group of cards with their hooked portions 37, 37.

By these operations, the cover 2 is brought up to its open position while holding one of the upper card group therein, thus opening the index to the desired page for the user.

Shown and described above is an embodiment where push-buttons integral with the selector arms are employed for the button operating mechanism, but the scope of the present invention is not to be limited to such embodiment. It is also possible to employ a system in which the operating buttons are slidably connectable to the selector arms such that the sliding displacement of a particular operating button will cause depression of the selector arm positioned therebelow.

What is claimed is:

1. An indexing device comprising:

(a) a base member;

(b) a cover member pivotally secured to the base member;

(c) a plurality of cards filed between the base member and the cover member, each card having a protrusion on an edge of the card, the protrusions on the plurality of cards each being at least in part exposed with respect to each other;

(d) a plurality of selector arms, mounted inside the cover member in correspondence to the exposed portions of the protrusions and operable through the cover member for selecting a desired card by downwardly depressing the protrusion of the desired card to form a gap between the desired card and the card immediately thereabove; and (e) a card-retaining means mounted inside the cover member for retaining the cards situated between the desired card and the cover member by engaging the card immediately above the desired card upon depression of a selector arm, the same being facilitated by the presence of the gap.

2. The indexing device of claim 1 further comprising a plurality of operating buttons each associated with a corresponding selector arm, the buttons projecting outwardly from the surface of the cover member.

3. The indexing device of claim 2 wherein the operating buttons and the selector arms are unitary.

4. The indexing device of claim 1 wherein the plurality of selector arms are each a tooth portion of a pectinated structure.

5. The indexing device of claim 1 wherein the cover member is biased toward an open position by a spring means and further comprises a locking arm in the base member for locking the cover member in a closed position.

6. The indexing device of claim 4 wherein said pectinated structure comprises an end portion uniting the tooth portions, the end porting being fixed to an inside surface of the cover member.

7. An indexing device comprising:

(a) a base member;

(b) a cover member pivotally secured to the base member and biased toward an open position by a spring means coupling the cover member and the base member;

(c) a lock arm provided in the base member for locking the cover member to its closed position with relation to the base member;

(d) a plurality of cards filed between the base and cover members, (e) each of said cards having formed at its front side a protruding marginal edge, such marginal edges of the respective cards being so arranged that when said cards are laid one over another, at least a portion of each protruding marginal edge is exposed;

(f) a plurality of selector arms provided inside the cover member for pivotal movement therewith and in correspondence to the exposed positions of the marginal edges of the respective cards for selecting a desired card by downwardly depressing the exposed portion of the desired card to form a gap between the desired card and the card immediately thereabove; and (g) retainer arms provided in the cover member for pivotal movement therewith for holding the cards situated between the cover member and the desired card upon depression of a selector arm and as the cover member pivots from the closed to the open position the same being facilitated by the presence of the gap.

8. An indexing device according to claim 7, further comprising operating buttons for depressing the associated selector arms positioned so as to project outwardly from the surface of said cover member.

9. An indexing device according to claim 8, wherein each of said operating buttons is formed integrally with the corresponding one of said selector arms.

10. An indexing device according to claim 7, wherein said selector arms are formed from the tooth portions of a pectinated structure having an end portion uniting the tooth portions fixed to an inside surface of the cover member.

11. An indexing device according to claim 7, wherein said lock arm is substantially L-shaped in section, with the lower arm portion of said arm being disposed beneath said cards, said arm also having formed in its upper arm portion a hole for engaging said cover member, and wherein the engagement between said lock arm and said cover member is released by a depressing force of one of said selector arms.

12. An indexing device according to claim 7, wherein a locking mechanism is provided between said lock arm and said retainer arms, said locking mechanism being arranged to be released by a displacing movement of said lock arm to thereby let said retainer arms grip said cards.

13. An indexing device comprising:

(a) a base member;

(b) a cover member, a rear end of which is pivotally secured to a rear end of the base member;

(c) a plurality of cards filed between the base member and the cover member, each card having a protrusion on its front edge, the cards being arranged so that at least a portion of each protrusion is exposed when the cards are laid one over another;

(d) a plurality of selector arms mounted on the cover member in correspondence to the exposed portions of the protrusions for downwardly depressing the protrusion of a desired card to form a gap between the desired card and the card immediately thereabove;

(e) retaining means mounted on the cover member for retaining the cards situated between the cover member and said desired card by engaging the protrusion of the cards to be retained upon depression of a selector arm by insertion of the retaining means in the gap thus formed; and (f) lock means on the base member for engaging the cover member to retain the cover member in a closed condition, the lock means contacting the retaining means when the cover is in the closed condition so as to position the retaining means apart from the protrusions on the front edges of the cards except when a selector arm is downwardly depressed.

14. The indexing device of claim 13 wherein the plurality of selector arms are each a tooth portion of a pectinated structure having a rear end portion integrally connecting the tooth portions, the rear end portion being fixed to an inside surface of the cover member, the front end of each selector arm being situated above the exposed portion of a protrusion on one of the plurality of cards, and wherein each selector arm further comprises an integral operation button projecting upward through an aperture in the cover member.

15. The indexing device of claim 13 wherein each of the plurality of selector arms further comprises a downwardly projecting tip portion overlying the corresponding exposed protrusion on one of the cards.

16. The indexing device of claim 13 wherein said lock means comprises:

an L-shaped lock arm pivotally supported inside the base, a lower arm portion of the lock arm extending beneath said plurality of cards, an upper arm portion including means for lockingly engaging said cover member, and means for restraining said retaining means, and means for biasing the L-shaped lock arm toward locking engagement with said cover member.

* * * * *